US005500965A

United States Patent [19]

Hannagan et al.

[11] Patent Number: 5,500,965

[45] Date of Patent: Mar. 26, 1996

[54] CUSHION

[75] Inventors: Angus P. D. Hannagan, Waterlooville; Michael A. McGrath, Portsmouth, both of England

[73] Assignee: Pegasus Airwave Limited, Waterlooville, England

[21] Appl. No.: 403,775

[22] PCT Filed: Sep. 28, 1993

[86] PCT No.: PCT/GB93/02024

§ 371 Date: Mar. 24, 1995

§ 102(e) Date: Mar. 24, 1995

[87] PCT Pub. No.: WO94/07396

PCT Pub. Date: Apr. 14, 1994

[30] Foreign Application Priority Data

Sep. 29, 1992 [GB] United Kingdom ..... 9220498

[51] Int. Cl.[6] ..... A61G 7/04

[52] U.S. Cl. ..... 5/654; 5/456; 5/453; 5/455; 297/452.41

[58] Field of Search ..... 5/453, 455, 653, 5/659, 450, 454, 456; 297/452.41

[56] References Cited

U.S. PATENT DOCUMENTS

| | | | |
|---|---|---|---|
| 1,576,211 | 3/1926 | Kane . | |
| 3,192,540 | 7/1965 | Swank | 5/654 |
| 3,983,587 | 10/1976 | Gorman | 5/654 |
| 4,864,671 | 9/1989 | Evans | 5/455 X |
| 5,029,939 | 7/1991 | Smith et al. | 5/654 X |
| 5,193,237 | 3/1993 | Holdredge | 5/654 |
| 5,228,156 | 7/1993 | Wany | 5/450 X |
| 5,379,471 | 1/1995 | Holdredge | 5/453 X |
| 5,423,094 | 6/1995 | Arsenault et al. | 5/456 X |

FOREIGN PATENT DOCUMENTS

| | | |
|---|---|---|
| 116470 | 8/1984 | European Pat. Off. . |
| 475593 | 3/1992 | European Pat. Off. . |

*Primary Examiner*—Michael F. Trettel
*Attorney, Agent, or Firm*—Larson and Taylor

[57] ABSTRACT

A cushion for the seat of a chair is provided, having at least two groups of cyclically inflatable tubes (4, 6, 8, 10), each group comprising at least one tube. Control means (18) inflates and deflates each group sequentially. The cushion also has a buffer chamber (12, 14) maintained by the control means (18) in communication with the inflated group or groups of cyclically inflatable tubes. The buffer chamber comprises at least one inflatable buffer tube which provides a part of the sitting surface of the chair.

13 Claims, 3 Drawing Sheets

CUSHION

TECHNICAL FIELD

This invention relates to controlledly inflatable cushions, particularly inflatable cushions for chairs such as wheelchairs, and to seats for chairs having such cushions and to chairs especially wheelchairs having such seats.

BACKGROUND ART

It is well-known that people, such as the disabled, who are confined to a bed or a wheelchair for long periods of time frequently suffer from sores, which result from areas near the surface of the skin being deprived of blood due to pressure exerted on those areas by the bodily support under the person's body weight. In the context of beds it is known, for example from GB-A-1595417, to provide a mattress comprising an array of hollow flexible tubes which are sequentially inflated and deflated, so that in effect pressure ripples travel along the length of the mattress. Thus while the person's body is continuously supported by the mattress, the actual regions of the body in contact with the mattress which bear the body weight change with time. This prevents any one area of the body being continuously deprived of blood and thus discourages the formation of pressure sores.

It is known from EP-A-475593 to provide a cushion for the seat of a chair comprising at least two groups of inflatable tubes arranged in a side-by-side relationship and oriented in a direction corresponding to the front to back direction of the chair seat. The tubes of a first group are a single tube or two or more adjacent tubes and the tubes of the each or other group are two or more spaced apart tubes arranged on opposite sides of the first group of tubes. The tubes of each group are inflatable together by a control unit, so that the group of tubes which support the body weight of a person sitting in the chair alternate with time.

The change in the region of the user's body supported by the cushion when a group of tubes are deflated encourages "reactive hyperaemia". This is the beneficial increase in blood supply to the region of the user's body no longer supported by the cushion. Reactive hyperaemia is maximised by deflating the tubes quickly to a condition where the pressure at the interface between the deflated tubes and the user's body is low, for example between 5 and 20 mmHg.

In EP-A-475593 the cycle of inflation of the groups of tubes is as follows:

i) inflate first group of tubes to maximum inflation;

ii) deflate second group of tubes;

iii) inflate second group of tubes to maximum inflation;

v) deflate first group tubes;

vi) repeat from step (i).

However, it is found that this type of cushion suffers from the disadvantage that the control unit often needs to switch on to inflate the tubes due to small pressure fluctuations in them. This can cause discomfort to the person sitting on the cushion. It is a particular problem when the cushion is provided with a portable power supply, typically a battery in a wheelchair, as it leads to excessive drainage of the supply.

In addition, during the steps (ii) and (iv) in the cycle of inflation, the bulk of the weight of the person sitting on the cushion is carried by one group of tubes. This leads to a large increase in the pressure inside the inflated tubes and causes them to deform. This increases the pressure at the interface between the user and the deflated tubes, thereby reducing the benefit to the user from reactive hyperaemia.

DISCLOSURE OF INVENTION

It is an object of the present invention to provide an inflatable cushion which reduces the frequency at which a control device needs to activate and increases the benefit of the cushion to the user from reactive hyperaemia.

In accordance with the invention, there is provided a cushion for the seat of a chair having at least two groups of cyclically inflatable tubes, each group comprising at least one tube, and control means for inflating and deflating said groups sequentially, said cushion further having a buffer chamber which is maintained by said control means in communication with the inflated group or groups of said cyclically inflated tubes, the buffer chamber comprising at least one inflatable buffer tube providing a part of the sitting surface of the cushion. While this inflatable buffer tube or tubes may be at any suitable location, e.g. the front or back of the cushion, it is most preferable that the buffer chamber is a pair of inflatable buffer tubes at opposite lateral sides of the sitting surface with the sequentially inflated groups of tubes between them.

Preferably, the cushion comprises at least two groups of inflatable tubes arranged for sequential inflation of the respective groups by the control means and arranged in a side-by-side relationship and oriented in a direction corresponding to the front to back direction of the chair seat, the tubes of the first group being a single tube or two or more adjacent tubes and the tubes of the each or other group being two or more spaced apart tubes arranged on opposite sides of the said first group of tubes.

The term "tube" is used herein for convenience to describe the inflatable flexible material chambers which provide sitting surfaces of the cushion. While such tubes are preferably elongate, they may be square or round as seen in plan view.

The cushion may include non-inflatable sitting surfaces.

The control unit may be a detachable control unit suitable for governing the inflation and deflation of the inflatable tubes, e.g. a modified form of the control unit disclosed in EP-A-475593. Alternative arrangements will be appreciated by persons skilled in the art.

In a preferred embodiment of the invention there are four sequentially inflatable parallel tubes, the two inner tubes being inflatable together to form a first group and the two outer tubes being inflatable together to form a second group. The buffer chamber preferably comprises two or more inflatable buffer tubes parallel to the four tubes arranged on opposite sides of the first and second group of tubes. The advantage of this conformation is that whichever groups of tubes is in the inflated condition, there is always a symmetrical arrangement of tubes to support the person sitting on the cushion.

According to the present invention, the groups of tubes are connectible to the buffer chamber so that when each group of tubes is inflated, it will be in fluid communication with the buffer chamber. This serves to damp the pressure fluctuations in the cushion and ensures that the control means does not activate a pump unnecessarily.

When one of the groups of tubes is deflated during the operating cycle of the cushion, the weight of the person sitting on the cushion is supported by the tubes remaining inflated. This causes an increase in the pressure in the inflated tubes. According to the present invention, the inflated tubes are connected to the buffer chamber and so this increase in pressure is distributed between the buffer chamber and the inflated tubes. This has the effect of reducing the amount of distortion the inflated tubes suffer and minimising any increase in the pressure at the interface between the user and the deflated tubes. This has the advantage of maximising the flow of blood to the interface between the user's body and the deflated tubes, encouraging reactive hyperaemia. It can be appreciated that the buffer chamber smooths out minor pressure fluctuations, e.g. those due to the shifting of the sitting person, so that the invention minimises the time during which the control means need to be operated, reducing the power consumption of the cushion. This is particularly important where a portable power supply is used to power the control means, for example in a wheelchair.

BRIEF DESCRIPTION OF DRAWINGS

Embodiments of the invention will now be described in further detail by way of non-limiting example, with reference to the accompanying drawings in which.

BEST MODE FOR CARRYING OUT THE INVENTION

Figure 1:
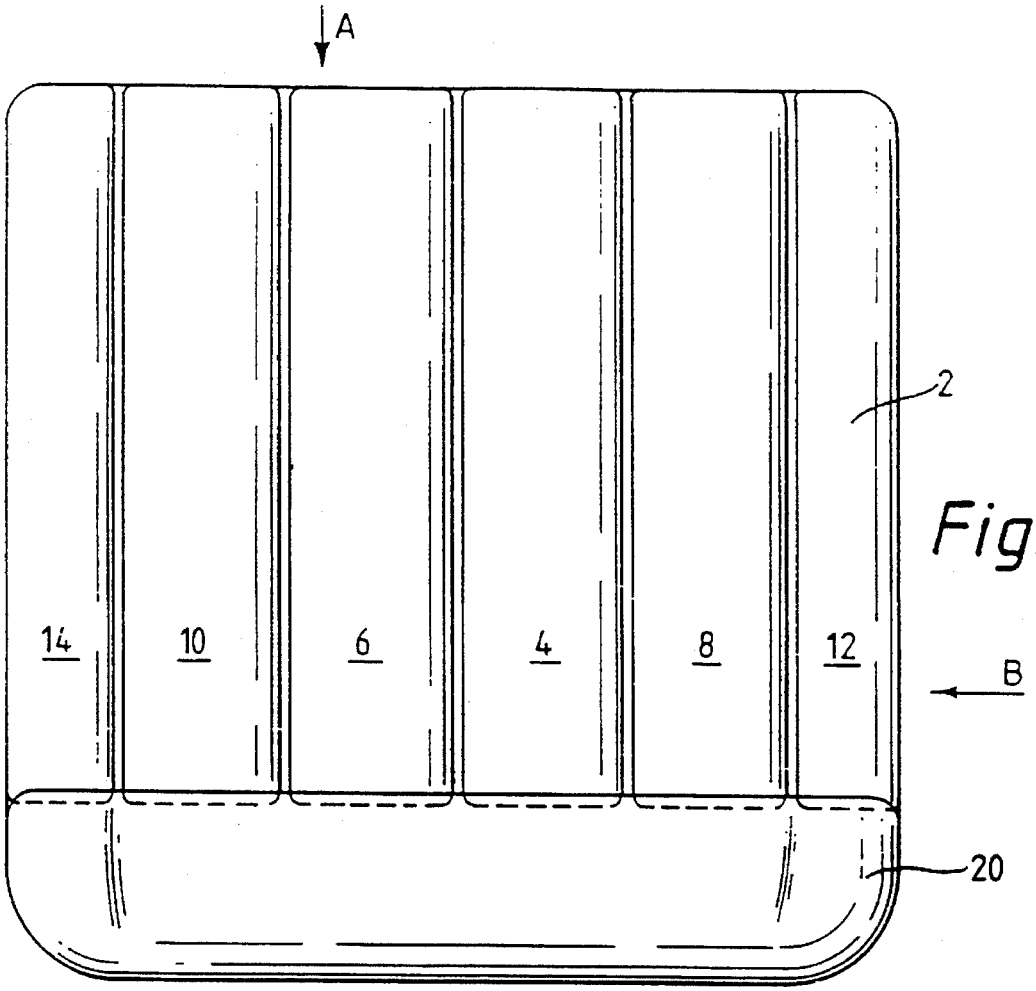
FIG. 1 is a plan view of a seat of a wheelchair embodying the invention.
Figure 2:
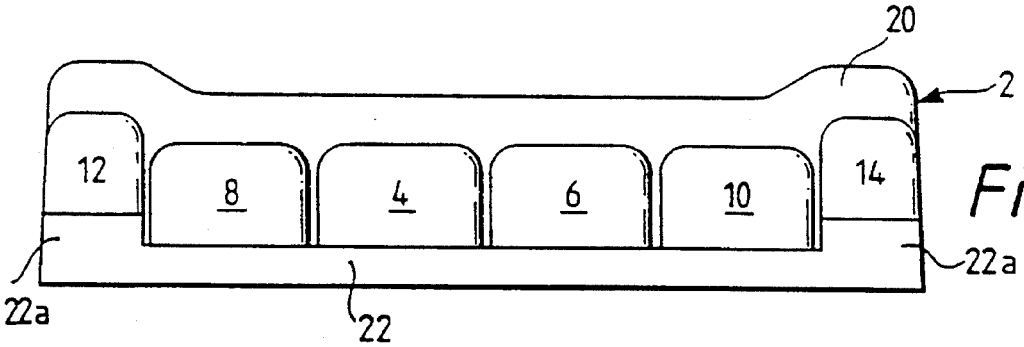
FIG. 2 is an elevation view of the rear of the seat in the direction of arrow A of FIG. 1.
Figure 3:
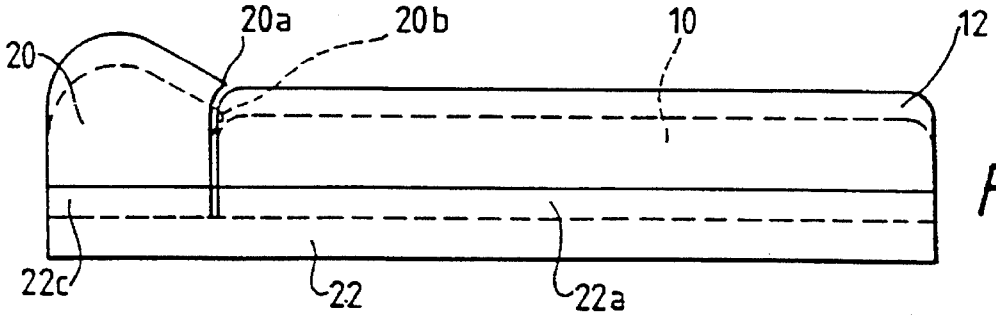
FIG. 3 is a side elevation view of the seat in the direction of arrow B of FIG. 1.

FIGS. 1 to 3 show a seat of a wheelchair having a cushion 2 providing the sitting surface i.e. the upper surface contacted by a user. The cushion has six inflatable elongate parallel tubes 4,6,8,10,12,14 arranged side-by-side on a base 22 in an abutting relationship and oriented in a direction corresponding to the front to back direction of the chair seat. The size of the cushion 2 and the dimensions of the tubes 4,6,8,10,12,14 are chosen to suit the particular use for which the cushion is used. To provide stability to the tubes, the tubes are of vacuum-formed plastics material so as to have a generally rectangular cross-section in their inflated state and adjacent tubes may be bonded together by any suitable means, e.g. adhesive. Each of the tubes 4,6,8,10,12,14 is formed of fluid impermeable, flexible material, for example a polyurethane. The outer tubes 12,14 are smaller in cross-section than the inner four tubes 4,6,8,10. The size is limited by the normal requirements of the human body and the requirement to fit into a conventional wheelchair. Typically both the overall side-to-side dimension and the front-to-back dimension of the sitting surface are in the range 35 to 50 cm.

The cushion is also provided with a non-inflatable resilient support 20 also forming part of the sitting surface and arranged along the front of the cushion 2 in the abutment with the ends of the tubes 4,6,8,10,12,14. The support is made of high density foam plastics with a long memory and has a transverse shape as shown in FIG. 3 including lips 20*a*,20*b* overlapping the tubes.

The six inflatable tubes 4,6,8,10,12,14 are supported by a rigid base 22 which is a wooden board having a central recess receiving the inner four tubes 4,6,8,10 bounded by lateral raised rim parts 22*a*, supporting the outer tubes 12,14 and a front raised rim part 22*c* supporting the foam support 20. The tubes 4,6,8,10,12,14 are secured, e.g. by adhesive, to the base 22.

Figure 5:
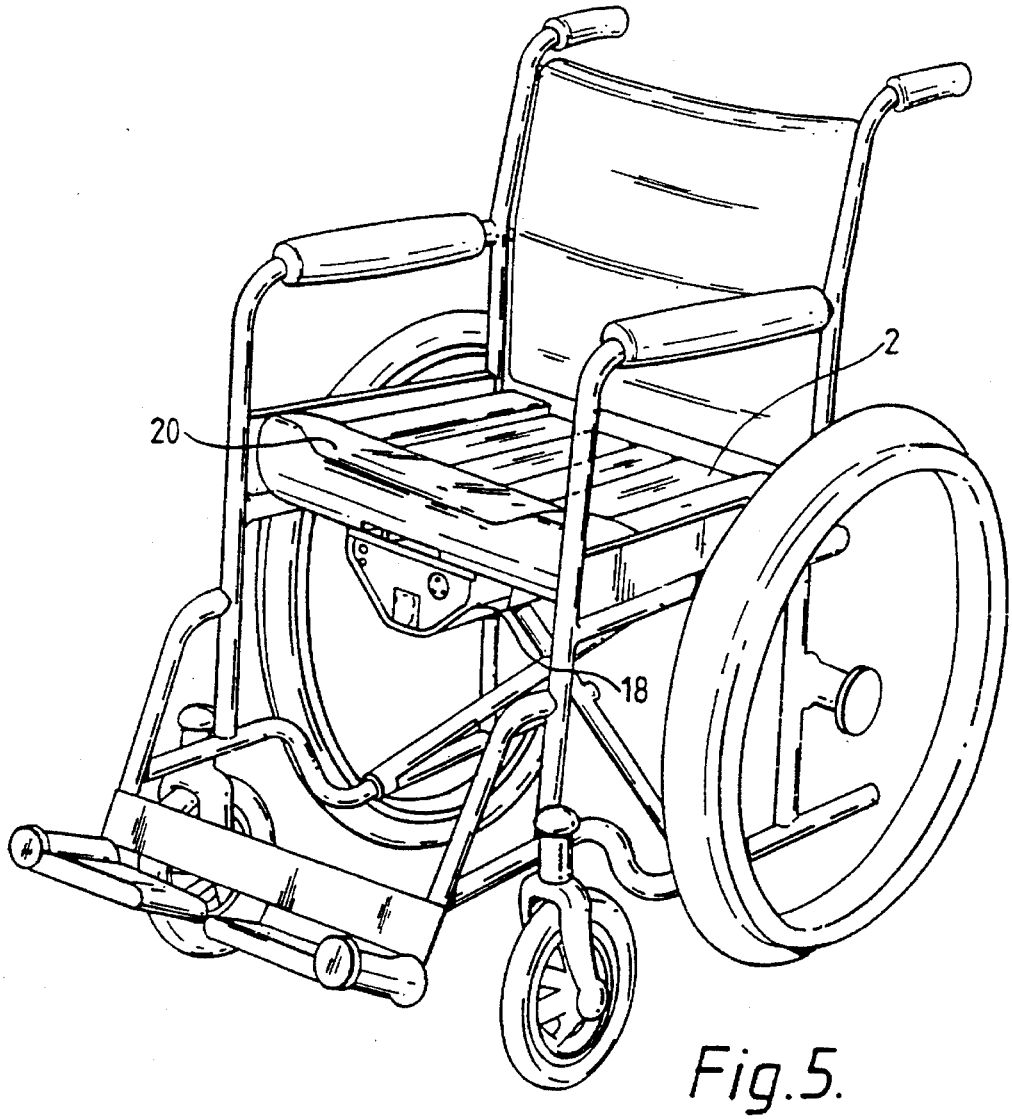
Fig.5 is a perspective view of a wheelchair including the seat.

FIG. 5 shows the seat 4, including cushion 2, base 22 and control unit 18, supported on the frame of a conventional wheelchair, which need not be further described.

Figure 6:
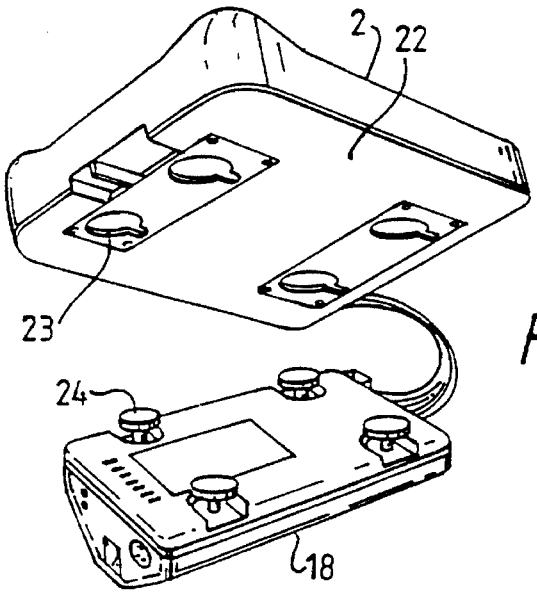
FIG. 6 is a perspective view of the seat including its control means, showing the connection of the control means to the seat.

At its underside, the base 22 has four keyhole shape slots 23 (see FIG. 6) which receive matching projecting flat-head pins 24 on the integral detachable control unit 18 which contains its own power supply in the form of a battery, an electric motor and an air compressing pump P driven by the motor , an air distributor 30, and actuator 40 and electric controlling circuits for these parts. These parts need not be shown in detail here. The base 22 therefore carries the whole of the control unit 18. In general this control unit 18 is similar to that shown and described in detail in EP-A-475593 to which reference should be made, except that the distributor 30 has additional passages leading to outlet 37*c* for connecting the buffer tubes 12,14 always to those ones of the sequentially inflated tubes 4,6,8,10 which are at any given time in the inflated state (i.e. the buffer tubes 12,14 are during operation not vented to the atmosphere but always maintained in inflated condition by the control unit).

The air lines connecting the tubes 4,6,8,10,12,14 to the control means 18 are not shown in FIGS. 1 to 3, but will be readily understood from the following description.

Figure 4:
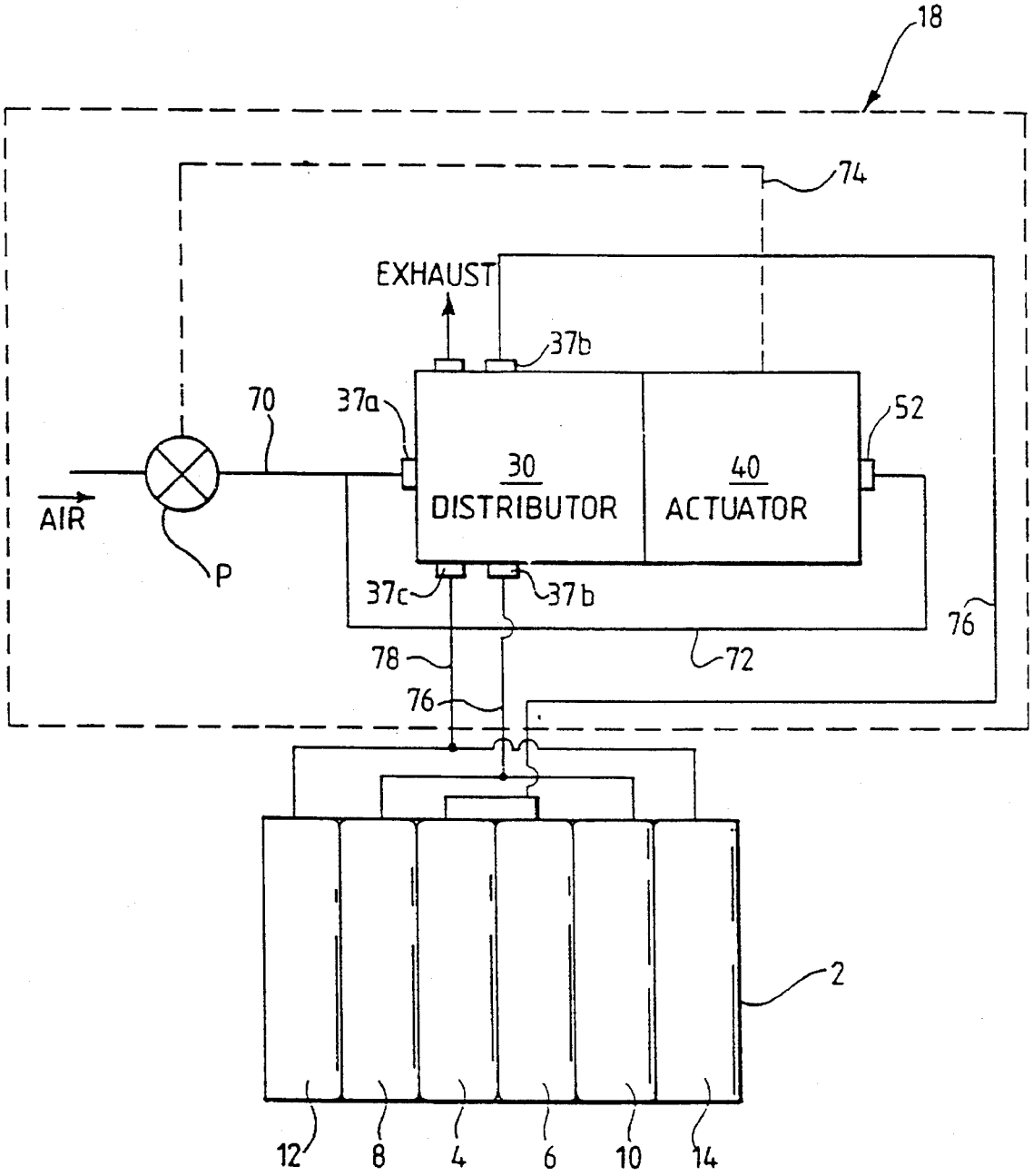
FIG. 4 shows diagrammatically the control means and how they are connected to the cushion.

The control unit 18 diagrammatically shown in FIG. 4 both senses the pressure in the tubes and inflates and deflates them in a pre-determined manner. Tubes 4 and 6 form a first group of tubes and tubes 8 and 10 form a second group of tubes. The two tubes in each group are inflatable together.

FIG. 4 shows diagrammatically how the control unit 18 is connected to the first and second groups of tubes 4,6,8,10, via respective supply lines 76 from respective outlets 37*b* of the distributor 30. The third outlet 37*c* is connected to the buffer tubes 12,14 by line 78. The pump P supplies pressurized air to an inlet 37*a* of the distributor 30 via a line 70. A connection 72 joins an adaptor 52 of the actuator 40 to the line 70, near the inlet of the distributor 30, so that the actuator senses the pressure at the outlet of the pump P and the inlet 37*a* of the distributor. The line 72 includes a flow restricting orifice, of 11/1000 inch diameter, to avoid transfer of pressure surges to the actuator 40. A broken line 74 indicates an electrical connection from the actuator 40 to the pump P by which the on-off control of the pump P is effected. When the pressure sensed by the actuator 40 reaches a preset minimum value, the actuator 40 switches the pump P on to raise the pressure in the inflated tubes. However, as the buffer tubes 12,14 are always connected via the distributor 30 to those ones of the tubes 4,6,8,10 which are inflated, the buffer tubes provides a hysteresis between the pressure in any groups of tubes falling below the minimum value and the pump P switching on. Therefore, the pump P does not activate in response to small fluctuations in pressure in the tubes, which avoids rapid switching on and off of the pump P and minimises the power drain on the supply.

Further, when a group of tubes are deflated, and the weight of the user's body is supported by the other group of tubes, the increase in pressure in the inflated tubes is distributed between the buffer tubes 12,14 and the inflated group of tubes. This reduces any distortion of the inflated tubes caused by the increase in weight which they support and reduces the pressure at the interface between the deflated tubes and the user's body in contact with them. This distribution of pressure means that the pressure in the inflated tubes and the buffer tubes 12,14 is less likely to exceed the maximum desired pressure.

The operating cycle of the cushion 2 effected by the distributor 30 will now be described:

The cycle is taken to start at a condition when all of the tubes 4,6,8,10,12,14 are in the fully inflated condition. Then, a first one of the two groups of tubes 4,6,8,10 are deflated by venting to atmosphere, so that the weight of the user is supported on the second group of tubes. This leads to an increase in the pressure in the inflated group of tubes. However, this increase is minimised as air from the inflated tubes passes via the distributor 30 into the buffer tubes 12,14, which act as a reservoir or buffer. Thus, the inflated tubes do not substantially distort and the pressure at the interface between the user's body is reduced and the deflated group of tubes is minimised. After a predetermined period of time, for example four minutes, air is supplied to the deflated first group of tubes, fully inflating them. The first group is then maintained at pressure for a further period of time, for example eight minutes, and during this period the other (second) group of tubes is deflated, while the first group of tubes is now kept inflated and connected to the buffer tubes 12,14. Thus, in the changeover between the first group of tubes and the second group of tubes, the second group of tubes are only allowed to deflate when all four tubes 4,6,8,10 have been in a fully inflated condition for a predetermined amount of time, which is preferably at least four minutes.

The cycle is completed by re-inflation of the second group of tubes after about a further four minutes, and then maintenance of all tubes in the inflated state for a period (again preferably at least four minutes). The deflation step of each group of tubes is rapid, to encourage reactive hyperaemia.

In this way for example a ratio of time when pressure is applied to the user at any point to time when pressure is not applied of about 2:1 (or even more) is obtained. This ratio also encourages reactive hyperaemia.

The operating cycle is repeated so that when a person is seated on the cushion for a long period of time, the areas of the body in contact with the sequentially inflated tubes 4,6,8,10 of the cushion do not support the body weight continuously.

Although body areas may be in contact with the continuously inflated buffer tubes 12,14, it has been found that the cyclic inflation of the tubes 4,6,8,10, combined with the normal shifting movements of a person in a wheelchair normally avoids discomfort and pressure sores.

Further advantages over the cushion of EP-A-475593 are greater comfort to the user because the inflated area of the cushion is always at least two-thirds of its total inflatable area and greater stability for the user.

We claim:

1. A cushion for the seat of a chair having at least two groups of cyclically inflatable tubes (4,6,8,10), each group comprising at least one tube, and control means (18) for inflating and deflating said groups sequentially, characterized in that said cushion further has a buffer chamber (12,14) which is maintained by said control means (18) in communication with the inflated group or groups of said cyclically inflatable tubes, said buffer chamber comprising at least one inflatable buffer tube which provides a part of the sitting surface of the chair.

2. A cushion according to claim 1 wherein said buffer chamber comprises two said buffer tubes (12,14) which both provide part of the sitting surface.

3. A cushion according to claim 2 wherein the buffer chamber comprises two inflatable tubes (12,14) arranged respectively on opposite sides of the first and second groups of tubes (4,6,8,10).

4. A cushion according to claim 3 wherein said opposite sides are opposite lateral sides of the cushion.

5. A cushion according to claim 1 wherein said cyclically inflatable tubes (4,6,8,10) are arranged in side-by-side relationship and oriented in a direction corresponding to the front-to-back direction of the chair seat, the tubes (4,6) of a first said group being a single tube or two or more adjacent tubes and the tubes (8,10) of the or each other said group being at least two spaced apart tubes arranged on opposite sides of said first group of tubes.

6. A cushion according to claim 5 wherein there are two said groups of said cyclically inflatable tubes, two inner such tubes (4,6) forming the first group of tubes and two outer tubes (8,10) forming the second group of tubes.

7. A cushion according to claim 1 wherein at least the cyclically inflatable tubes (4,6,8,10) are pre-formed to have a rectangular cross-section when inflated.

8. A cushion according to claim 1 wherein said control means (18) effect an inflation sequence of said cyclically inflatable tubes (4,6,8,10) in which for at least one period of time all said cyclically inflatable tubes are simultaneously inflated.

9. A cushion according to claim 8 wherein in said inflation sequence, the period during which each said group of cyclically inflatable tubes is inflated is longer than the period during which that group is deflated.

10. A seat for a chair, for example a wheelchair, comprising a cushion according to claim 1.

11. A seat according to claim 10 having a base (22) supporting at least said cyclically inflatable tubes (4,6,8,10), said base (22) carrying said control means (18).

12. A seat according to claim 11 wherein, of said control means (18), at least a power source, an air pump driven by said power source and a distributor of air to said cyclically inflatable tubes are carried by said base (22) underneath said cushion.

13. A chair, for example a wheelchair, having a seat according to claim 10.

* * * * *

UNITED STATES PATENT AND TRADEMARK OFFICE

CERTIFICATE OF CORRECTION

PATENT NO. : 5,500,965

DATED : March 26, 1996

INVENTOR(S) : HANNAGAN et al.

It is certified that error appears in the above-indentified patent and that said Letters Patent is hereby corrected as shown below:

Column 5, line 54, delete "(4,6,8,10)".

Column 6, line 1, delete "(18)";
lines 2-3, delete "sequentially, characterized in that" and insert --in a predetermined sequence in which at any time at least one said group is inflated, wherein--;
line 3, delete "(12,14)";
line 4, delete "(18)";
line 10, delete "(12,14)";
line 13, delete "(12,14)";
line 15, delete "(4,6,8,10)";
line 19, delete "(4,6,8,10)";
line 21, delete "(4,6)";
line 23, delete "(8,10)";
line 28, delete "(4,6)";
line 29, delete "(8,10)";
line 31, delete "(4,6,8,10)";
line 34, delete "(18)";
line 35, delete "(4,6,8,10)";
line 42, delete "for example a wheelchair,";
line 44, delete "(22)";
line 45, delete "(4,6,8,10)";
line 46, delete "(22)";
line 46, delete "(18)";
line 47, delete ", of";
line 48, delete "(18)," and insert --comprises--;

UNITED STATES PATENT AND TRADEMARK OFFICE

CERTIFICATE OF CORRECTION

PATENT NO. : 5,500,965

DATED : March 26, 1996

INVENTOR(S) : HANNAGAN et al.

It is certified that error appears in the above-indentified patent and that said Letters Patent is hereby corrected as shown below:

Column 6, line 50, delete "are" and insert --, said power source, air pump and distributor being--;

line 50, delete "(22)" and insert --and being positioned--;

line 52, delete ", for example a wheelchair,";

after line 53, insert the following new claim:

-- 14. A wheelchair having a seat having a cushion according to claim 1.--

Signed and Sealed this

Eighteenth Day of June, 1996

*Attest:*

*Attesting Officer*

BRUCE LEHMAN

*Commissioner of Patents and Trademarks*